US005332195A

United States Patent [19]

Sugiyama

[11] Patent Number: 5,332,195

[45] Date of Patent: Jul. 26, 1994

[54] ROPE TRACTION DEVICE

[75] Inventor: Yutaka Sugiyama, Tokyo, Japan

[73] Assignee: Nitton Biso Co., Ltd., Tokyo, Japan

[21] Appl. No.: 7,750

[22] Filed: Jan. 22, 1993

[51] Int. Cl.[5] ..... B66D 1/30

[52] U.S. Cl. ..... 254/371; 187/22; 226/186

[58] Field of Search ..... 187/22, 30; 254/371, 254/372, 408; 474/46, 8; 226/186, 181

[56] References Cited

U.S. PATENT DOCUMENTS 3,635,441 1/1972 Haines ..... 354/371

4,345,741 8/1982 Rinio et al. ..... 254/371

*Primary Examiner*—Kenneth W. Noland

*Attorney, Agent, or Firm*—Hedman, Gibson & Costigan

[57] ABSTRACT

A rope traction device has a sheave which is driven and rotated to cause a traction rope to be wound on the sheave and thereby moves along the traction rope. The rope traction device includes a pair of annular side plates made of an elastic material and provided at sides of the sheave in such a manner that the interval between the inner surfaces of the side plates is made smaller than the diameter of the rope by a predetermined value and the side plates are secured to the sides of the sheave by means of boltheads of bolts arranged alternately in the circumferential direction of the sheave. The side plates may alternately be secured to the sides of the sheave by means of boltheads of bolts and nuts positioned at opposite positions in the circumferential direction of the sheave.

4 Claims, 6 Drawing Sheets

ROPE TRACTION DEVICE

BACKGROUND OF THE INVENTION

This invention relates to a rope traction device and, more particularly, to an improvement in a rope traction device suitable for use in construction, loading and unloading and conveying machines including moving scaffolds, elevators and cranes.

A rope traction device is a type of winding instrument used for construction, loading and unloading and conveying machines and is capable of moving up and down along a rope with the rope wound around its sheave by only one or few windings and without winding the rope around and feeding it from a drum.

An example of a prior art rope traction device used for moving up and down a moving scaffold for performing a work along an exterior wall surface of a building is shown in FIG. 7. This rope traction device includes a frame 1, a drive shaft 2 mounted on the frame 1, a motor (not shown) provided on the outer periphery of the drive shaft 2 through a bearing and a sheave 4 driven by this motor. The rope traction device further includes a traction mechanism 6 for holding a rope 5 wound about this sheave 4 by one winding for preventing the rope 5 from slipping off the sheave 4 and further a brake mechanism (not shown).

This traction mechanism 6 includes an L-shaped pivoting arm 8 provided in the vicinity of a point at which the rope 5 is disengaged from the sheave 4. A pair of rollers 9, 9 are rotatably mounted at one end of the pivoting arm 8 to press the rope 5 inwardly from a straight tightened state thereof. Another pair of rollers 10, 10 are rotatably mounted on a pivoting arm 11 which is pivotably mounted at the other end of the pivoting arm 8.

According to this structure, as the rope 5 becomes straightly tightened, the rollers 9, 9 which are in contact with the rope 5 are pushed by the rope outwardly and the pivoting arm 8 thereby is pivoted in a counterclockwise direction to cause the rope 5 to be pressed by the rollers 10, 10 to the groove of the sheave 5.

In the traction mechanism 6 described in which the rope 5 is pressed against the sheave 4 by the pair of rollers 10, 10 mounted on the pivoting arm 11, bending moment is repeatedly applied to the rope 5 at points of contact with the V-shaped groove of the sheave 4 at two positions at which the rollers 10, 10 tend to slip sideways by force applied in transverse direction by twisting of the rope 5. For these reasons, wear occurs in the rope 5 and the life of the rope 5 thereby is shortened.

It is, therefore, an object of the invention to provide a rope traction device capable of producing a large rope pressing force and ensuring a prolonged life of the rope without causing wear in it.

SUMMARY OF THE INVENTION

A rope traction device achieving the above described object of the invention has a sheave which is driven and rotated to cause a traction rope to be wound on the sheave and thereby moves along the traction rope and is characterized in that said rope traction device comprises a pair of annular side plates made of an elastic material and provided at sides of the sheave to form a groove in which the rope is received in such a manner that the interval between the inner surfaces of the side plates is made smaller than the diameter of the rope by a predetermined value and the side plates are secured to the sides of the sheave by means of bolts alternately in the circumferential direction of the sheave.

According to the invention, since the side plates made of an elastic material are secured to the sides of the sheave by means of bolts alternately in the circumferential direction of the sheave, and the interval between the inner surfaces of the side plates is made smaller than the diameter of the rope, when the rope is received between the side plates, a portion of one of the side plates which is not secured to the sheave by the bolt but is located on the opposite side of a portion of the other side plate which is secured to the sheave by the bolt is flexed in the opposite direction to the portion of the side plate which is secured to the sheave by the bolt, so that the respective side plates are flexed undulatingly in the circumferential direction. As a result, a component force is produced due to the tension of the rope which component force is directed from the center of the rope to the portion of the side plate which is secured to the sheave by the bolt and this increases frictional force acting between the rope and the side plates with the result that the pressing force excerted by the side plates to the rope also increases whereby transmission of power from the sheave to the rope is efficiently performed.

In one aspect of the invention, the rope traction device has a sheave which is driven and rotated to cause a traction rope to be wound on the sheave and thereby moves along the traction rope and is characterized in that said rope traction device comprises a pair of annular side plates made of an elastic material and provided at sides of the sheave to form a groove in which the rope is received in such a manner that the interval between the inner surfaces of the side plates is made smaller than the diameter of the rope by a predetermined value and the side plates are secured to the sides of the sheave by means of bolts at opposite positions in the circumferential direction of the sheave.

According to this aspect of the invention, since the side plates are secured to the sides of the sheave by means of bolts at opposite positions in the circumferential direction, the rope received in the groove formed by the side plates is clamped and deformed so as to reduce its diameter in portions of the side plates which are secured to the sheave at opposite positions by means of the bolts whereas portions of the side plates which are not secured to the sheave are flexed outwardly on both sides and, as a result, a wedging force acts on the portions of the side plates which are secured to the sheave by the bolts due to the tension of the rope. As a result, frictional force acting between the rope and the side plates increases with resulting increase in the pressing force excerted by the sheave to the rope.

Preferred embodiments of the invention will be described below with reference to the accompanying drawings.

BRIEF DESCRIPTION OF THE DRAWINGS

In the accompanying drawings,

FIGS. 1A, 1B and 1C are figures showing an example of a sheave used in a first embodiment of the rope traction device according to the invention in which FIG. 1A is a perspective view of the sheave, FIG. 1B is a plan view showing the state of bolt positions and FIG. 1C is a vertical section showing a part of the state of the bolt positions;

FIGS. 2A, 2B and 2C are figures showing an example of a sheave used in a second embodiment of the traction device of the invention in which FIG. 2A is a perspective view of the sheave of the embodiment, FIG. 2B is a plan view showing the state of bolt positions and FIG. 2C is a vertical section showing a part of the state of the bolt position;

DESCRIPTION OF PREFERRED EMBODIMENTS

Figure 1A:
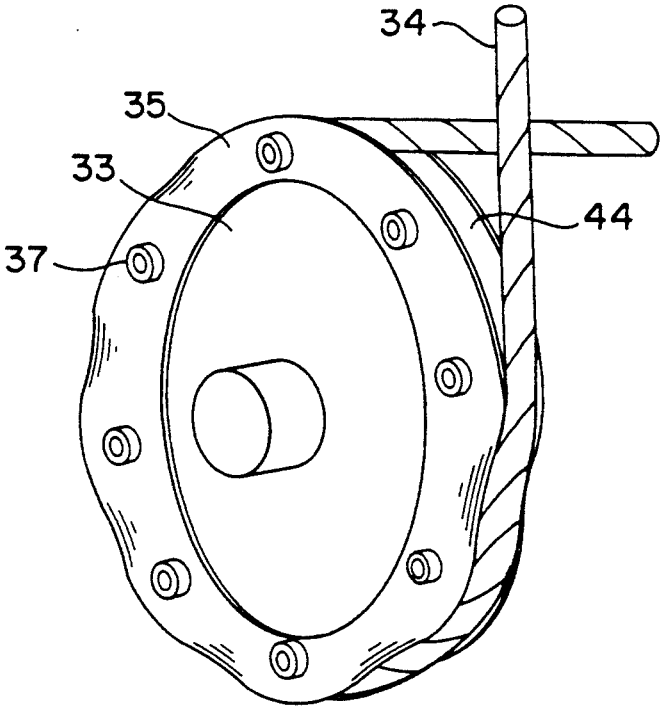

Referring to FIGS. 1 and 3 to 5 showing a first embodiment of the invention, a rope traction device 30 includes a sheave 32 which is mounted to a frame 31. The sheave 32 includes a sheave main body 33 and a pair of side plates 35, 35 which form a groove 44 (FIG. 1) for receiving a wire rope 34.

Figure 3:
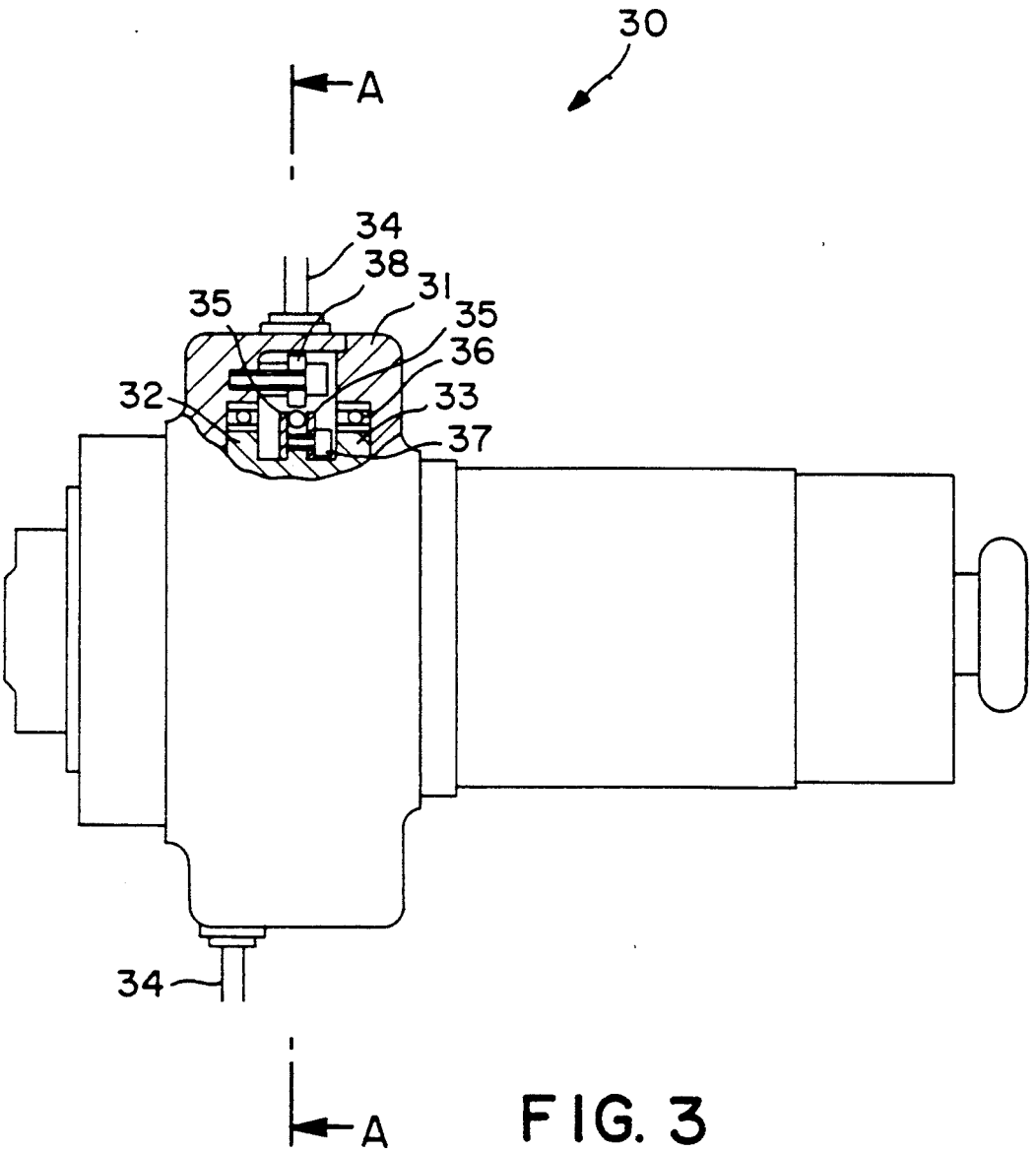
FIG. 3 is a front view showing the first embodiment of the rope traction device according to the invention.
Figure 4:
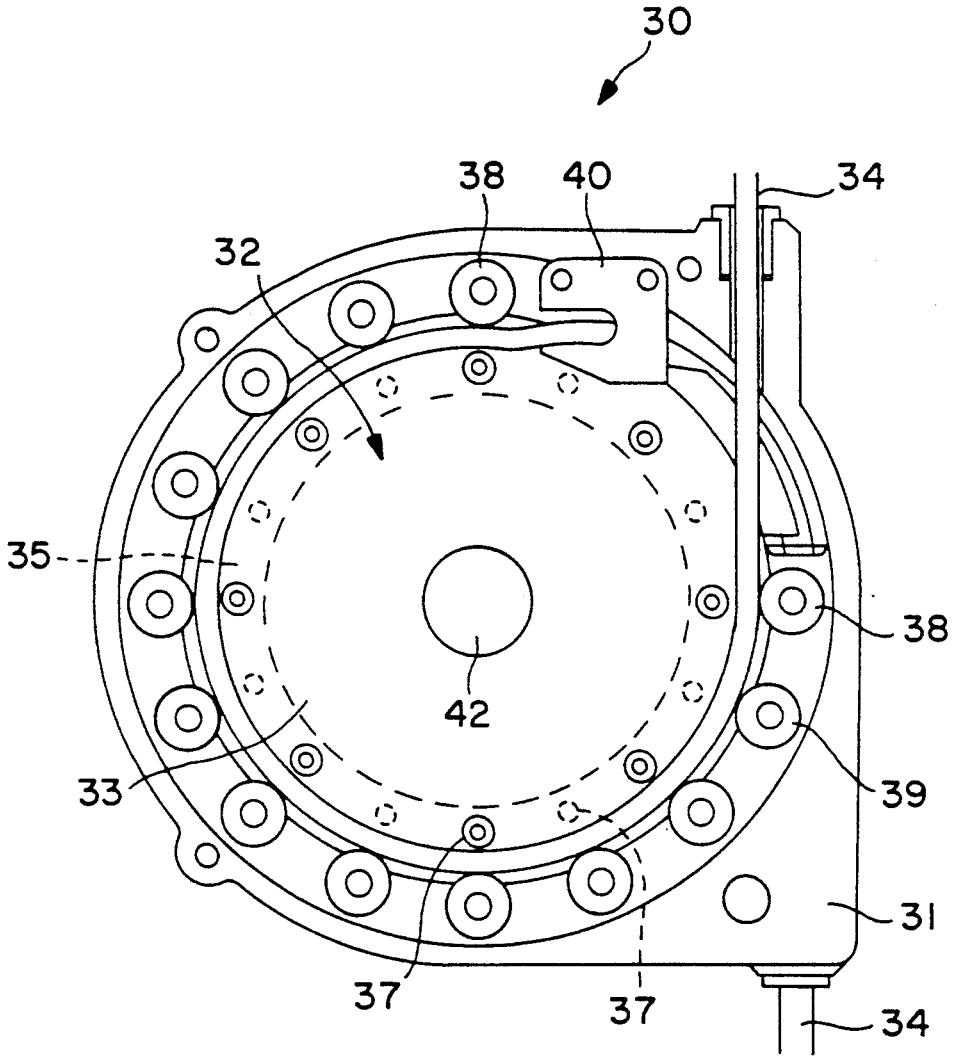
FIG. 4 is a sectional view taken along arrows A—A in FIG. 3.

The outer peripheral surface which forms the bottom of the groove 44 of the sheave main body 33 is knurled, if necessary, to increase friction acting between the wire rope 34 and the bottom 44 of the sheave main body 33. Outer peripheral portions of the sheave main body 33 on both sides of the side plates 35 extend radially outwardly and these outer peripheral portions are mounted rotatably to the frame 31 through ball bearings 36 (FIG. 3).

Figure 1B:
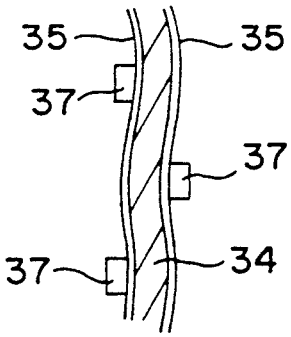

The side plates 35, 35 are made of annular leaf springs which are secured to the sheave main body 33 by means of boltheads of bolts 37 arranged alternately in the circumferential direction as shown in FIG. 1B.

Figure 1C:
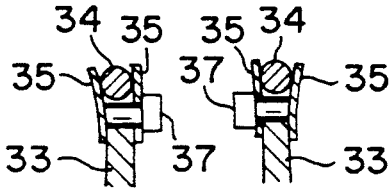

As shown in FIG. 1C, each of the boltheads of the bolts 37 secures one of the side plates 35 to the sheave main body 33 but does not secure the other side plate 35 to the sheave main body 33 in order to allow the other side plate 35 at this position to flex freely. The interval between the inner surfaces of the side plates 35, 35 is made smaller than the diameter of the wire rope 34 by a predetermined value.

For ensuring guiding of the wire rope 34 along the sheave 32, guide rollers 38 and 39 (FIG. 4) are mounted at equal interval on the portions of the frame 31 outside of the sheave 32. Except for the two guide rollers 38 disposed at the entrance and exit for the wire rope 34, the guide rollers 39 are disposed in such a manner that the radially outermost portion of each roller 38 enters the groove 44 between the two side plates 35, 35 without contacting the wire rope 34 received in the groove 44. The two guide rollers 38 disposed at the entrance and exit for the wire rope 34 have a roller width which is slightly larger than the diameter of the wire rope 34 to press the side plates 35, 35 apart and thereby facilitate feeding in and out of the wire rope 34.

A wire guide 40 is fixedly secured outside of the exit side guide roller 38 for facilitating smooth feeding out of the wire rope 34.

The sheave 32 is driven for rotation by a drive mechanism (not shown) provided on a drive shaft 42. Since this drive mechanism is well known in the art, description thereof will be omitted.

The operation of the above described rope traction device 30 will now be described.

Before the sheave 32 is rotated, the wire rope 34 is wound on the sheave by about a single winding and is received in the groove 44 formed by the side plates 35, 35 with the radially outward movement of the wire rope 34 being restricted by the guide rollers 38 and 39 and the wire rope 34 being pressed on both sides thereof by the side plates 35, 35. As the sheave 32 is rotated by the unillustrated drive mechanism, the drive power is transmitted through the side plates 35, 35 to the wire rope 34 and therefore the rotating sheave moves along the wire rope 34.

Figure 5:
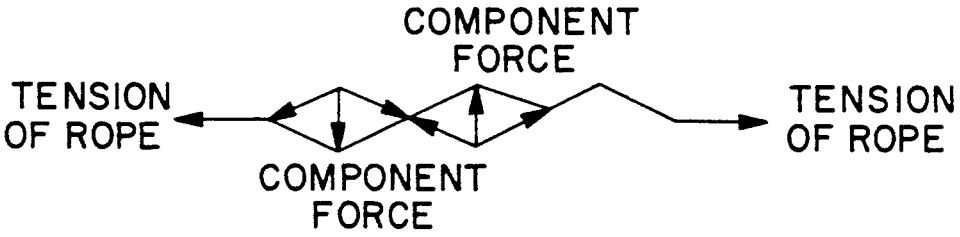
FIG. 5 is a diagram showing an operation of the first embodiment of the invention.

Since the interval between the inner surfaces of the side plates 35, 35 is made smaller than the diameter of the wire rope 34 by a predetermined value, the portion of the side plate 35 which is not secured to the sheave main body 33 by the bolt 37 is pressed by the wire rope 34 and is flexed in the opposite direction to the portion of the other side plate 35 which is secured to the sheave main body 33 by the bolt 37 as shown in FIGS. 1B and 1C and, accordingly, the side plates as a whole are flexed undulatingly in the circumferential direction of the sheave 32 as shown in FIG. 1B. When the sheave 32 is rotated, as shown in FIG. 5, a component force is produced due to the tension of the wire rope 34 which component force is directed from the center of the wire rope 34 to the portion of the side plate 35 which is secured to the sheave main body 33 by the bolt 37 and this increases frictional force acting between the wire rope 34 and the side plates 35, 35 with the result that the pressing force excerted by the side plates 35, 35 to the wire rope 34 also increases whereby transmission of power from the sheave 32 to the wire rope 34 is efficiently performed.

Figure 2A:
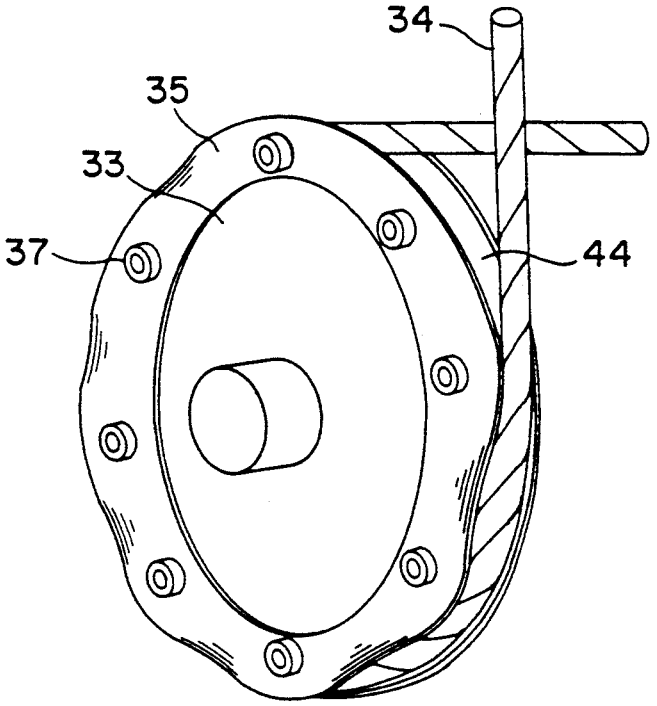
Figure 2B:
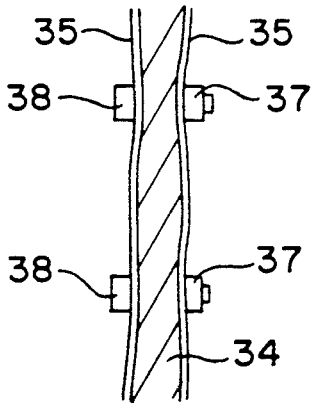
Figure 2C:
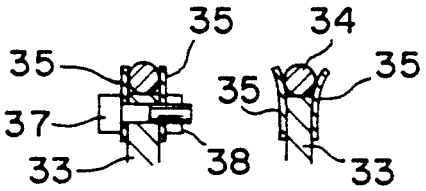
Figure 6:
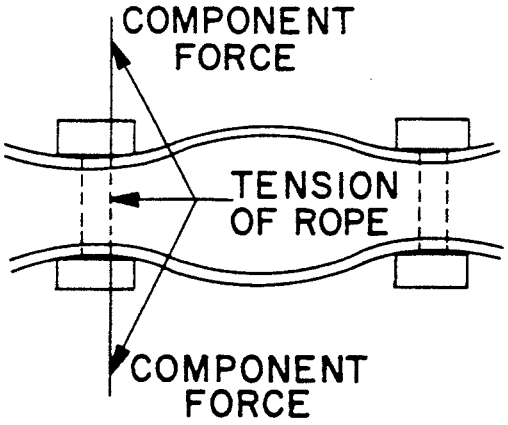
FIG. 6 is a diagram showing an operation of the second embodiment of the invention.
Figure 7:
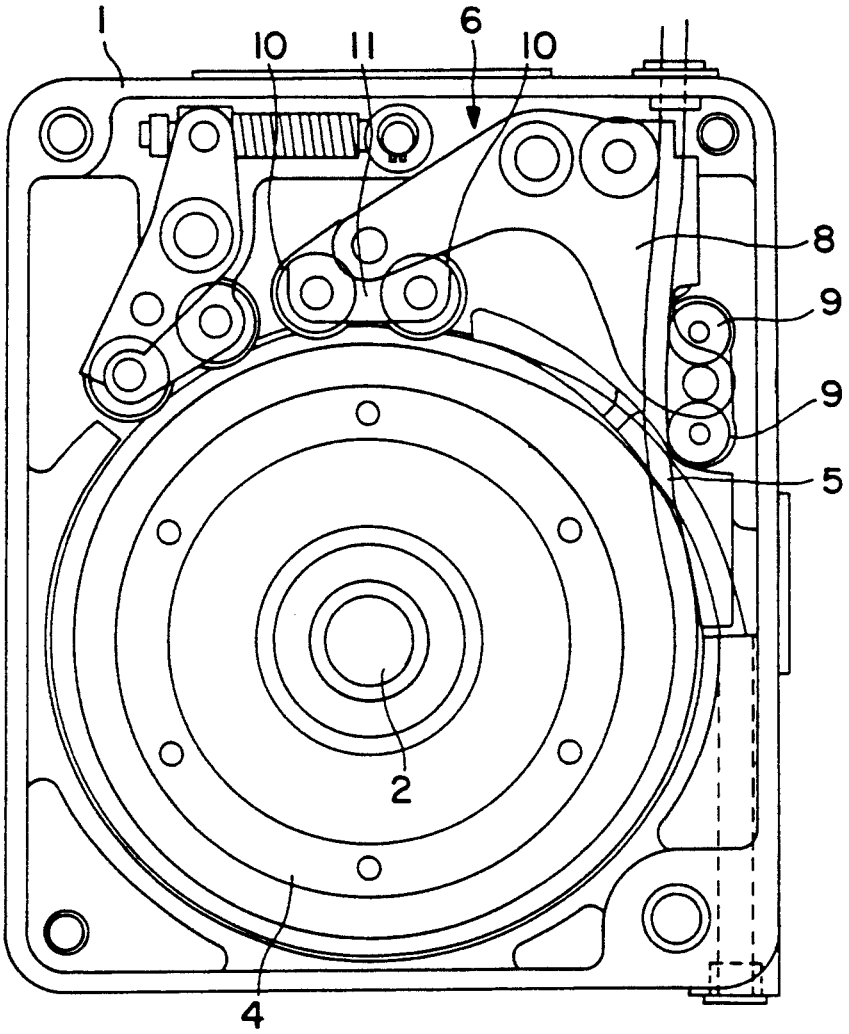
FIG. 7 PRIOR ART
FIG. 7 is a sectional view showing a prior art rope traction device.

Referring to FIGS. 2 and 6, a second embodiment of the invention will be described. In this embodiment, the general structure of the rope traction device is the same as that of the above described first embodiment so that description thereof will be omitted.

In this embodiment, side plates 35, 35 made of leaf springs are secured to the sides of the sheave main body 33 at opposite positions in the circumferential direction by means of bolts 37 which are inserted through openings formed through the sheave main body 33 and the two side plates 35, 35 and nuts 38 which are threaded to the bolts 37. The interval between the side plates 35, 35 is made smaller than the diameter of the wire rope 34 by a predetermined value.

In this embodiment, since the side plates 35, 35 are secured to the sides of the sheave main body 33 by means of the boltheads of the bolts 37 and the nuts 38 at opposite positions in the circumferential direction, the wire rope 34 received in the groove 44 formed by the side plates 35, 35 is clamped and deformed so as to reduce its diameter in portions of the side plates 35, 35 which are secured to the sheave main body 33 at opposite positions by means of the boltheads of the bolts 37 and nuts 38 whereas portions of the side plates 35, 35 which are not secured to the sheave main body 33 are flexed outwardly on both sides and, as a result, a wedging force acts on the portions of the side plates 35, 35 which are secured to the sheave main body 33 by the bolts 37 and the nuts 38 due to the tension of the wire rope 34. As a result, frictional force acting between the wire rope 34 and the side plates 35, 35 increases with resulting increase in the pressing force excerted by the sheave 32 to the wire rope 34.

I claim:

1. A rope traction device having a sheave which is driven and rotated to cause a traction rope to be wound on the sheave and said rope traction device thereby moving along the traction rope, said device being characterized in that said rope traction device comprises a pair of annular side plates made of an elastic material and provided at the side of the sheave in such a manner that the space between the inner surfaces of the side plates is made smaller than the diameter of the rope by a predetermined value and the side plates are secured to the side of the sheave by means of boltheads of bolts positioned alternately on opposite sides of the sheave in the circumferential direction of the sheave to permit the adjacent side plate portion opposite to the boltheads to flex freely outwardly to create a wedging force about a traction rope.

2. A rope traction device as defined in claim 1 wherein said side plates are made of a pair of leaf springs.

3. A rope traction device having a sheave which is driven and rotated to cause a traction rope to be wound on the sheave and said rope traction device thereby moving along the traction rope, said device being characterized in that said rope traction device comprises a pair of annular side plates made of an elastic material and provided at sides of the sheave in such a manner that the space between the inner surfaces of the side plates is made smaller than the diameter of the rope by a predetermined value and the side plates are rigidly secured to the side of the sheave by means of boltheads of bolts positioned on one side plate of the side plates and nuts positioned on opposite sides of the boltheads in the circumferential direction of the sheave to permit side plate portions to flex freely outwardly between the boltheads and the nuts to create a wedging force about a traction rope.

4. A rope traction device as defined in claim 3 wherein said side plates are made of a pair of leaf springs.

* * * * *